United States Patent [19]

Abe et al.

[11] 4,380,964

[45] Apr. 26, 1983

[54] HOLDING SPINDLE FOR PRINTING AND COATING CYLINDRICAL CONTAINERS

[75] Inventors: Katsuo Abe; Masahiro Nishio; Akira Matsubara, all of Ishioka, Japan

[73] Assignee: Toyo Seikan Kaisha, Ltd., Tokyo, Japan

[21] Appl. No.: 240,438

[22] Filed: Mar. 4, 1981

[51] Int. Cl.[3] ..... B05C 13/00

[52] U.S. Cl. ..... 118/50; 118/500; 101/38 R; 279/3

[58] Field of Search ..... 118/500, 502, 233, 46, 118/50; 279/3; 269/21; 101/38 R, 38 A, 39, 40

[56] References Cited

U.S. PATENT DOCUMENTS 3,682,296 8/1972 Buhayor et al. ..... 101/40 X
4,092,949 6/1978 Balordi ..... 101/40 X

FOREIGN PATENT DOCUMENTS 2358158 6/1974 Fed. Rep. of Germany ..... 101/40

*Primary Examiner*—John D. Smith
*Assistant Examiner*—Bernard F. Plantz
*Attorney, Agent, or Firm*—Jordan and Hamburg

[57] ABSTRACT

A holding spindle mountable on a spindle shaft and utilized for printing and coating cylindrical containers includes an outer sleeve for receiving a cylindrical container, the outer sleeve having an inner diameter less than the diameter of the cylindrical container to thereby provide a clearance between the outer sleeve and the cylindrical container disposed thereon. Bearings rotatably mount the outer sleeve on the spindle shaft. A bottom receiving pad on the outer sleeve has a seating surface having a curvature corresponding to the curvature of the bottom surface of the cylindrical container. An aspirating device applying a vacuum to the seating surface has an opening in the seating surface leading to a source of vacuum and providing a vacuum to effect seating and mating of the common curvature of the seating surface and the inside bottom surface of the cylindrical container to thereby enhance the stability of the cylindrical container on the holding spindle. A mounting device detachably mounts the bottom receiving pad on the outer sleeve to provide for readily replacing and changing the bottom receiving pad to accommodate cylindrical containers having bottom surfaces of differing curvature.

1 Claim, 5 Drawing Figures

HOLDING SPINDLE FOR PRINTING AND COATING CYLINDRICAL CONTAINERS

This invention relates to a holding spindle for printing and coating outer peripheral surfaces of thin elastic cylindrical containers with bottoms, for example, an empty can, a plastic cup, a tube and so forth.

Since a thin elastic cylindrical container with a bottom is easily deformed by external force, the cylindrical container must be held and conveyed when the printing and coating pressures are applied to the outer peripheral surface of the container body at the printing and coating stations of the printing and coating apparatus, and are precisely acted on at the outer peripheral surface of the container to prevent deformation in the container. In view of this point, printing and coating apparatus generally have holding spindles as container holders. The holding spindle is made from a simple material of plastic, metal, ceramics and so on or a combination thereof. To easily place the cylindrical container around and remove it from the outer circumference of the holding spindle, for example, in case the cylindrical container ranges in inside diameter from 20 to 100 mm, the diameter of the holding spindle will be made smaller than the inside diameter of the container by 0.1 to 0.5 mm. Thus, there is a very small clearance between the body of the container and the outer body of the holding spindle when the container is disposed around the outer circumference of the holding spindle. The range of this clearance is selected so that crucial influences do not affect the printing and coating qualities in the printing and coating processes.

Generally, while the container disposed around the outer circumference of the holding spindle receives necessary printing and coating treatments in the work and conveyance processes, the vacuum pressure supplied from a base end into the interior of the holding spindle holds the bottom end of the container to maintain a precise position and desired position.

Referring to FIG. 1 there is shown a conventional holding spindle (A) for a two-piece can of which the inside bottom (10*a*) of a bottom (10) is concavely formed in a dome shape and in which a conjunction radius portion (14) to a can body (12) is formed at the periphery of the bottom end. A tip periphery (16*a*) of a spindle body (16) directly contacts the boundary conjunction radius portion (14) between the can body and the can bottom and has a sealing action for holding the can body (12) by the vacuum pressure supplied from a vacuum-source aperture (18) and a position-determination jig action for accurately determining a settlement position of the empty can (a).

The spindle (A) holding the can (a) performs to coat the outer peripheral surface during rotation upon contact with a coating roller or a printing bracket in the printing and coating stations of a printing and coating apparatus. At this time, many slight slidings occur between the holding spindle (A) and the can (a). The reasons for this are as follows; (1) there exists a small clearance between the inside of the can (a) and the body of the holding spindle; (2) a speed difference results due to the difference in rotational speed between the holding spindle (A) and the coating roller or the printing bracket in accordance with the necessary or difference of the rotary inertial force.

The sliding phenomenon has a comparatively stronger contact pressure between the conjunction radius portion (14) of the can (a) and the tip periphery (16*a*) of the holding spindle than in any other parts owing to the vacuum seal action with frequent occurences of damage and reduction of quality values in cans (a), while abrasion is produced in the tip periphery (16*a*) of the holding spindle resulting in a lack of function of the vacuum seal and the positioning of the cans (a).

Various improvements have been conventionally made to prevent these phenomenon. For example, as illustrated in FIG. 2, a non-damage prevention means is provided in which the material of only the tip (20) including the tip periphery (20*a*) of the holding spindle (B) is replaced with another material different from that of the spindle body (22). Soft plastic material attenuates further abrasion-proof qualities.. Conversely, an abrasion-proof increase mean that the material of the holding spindle is replaced with ceramics, super-hard alloy hard alloy steel or that surface treatment is made by chromium galvanizing and positive pole oxidase increases the occurrence ratio of damages in cans (a).

Referring to FIG. 3 showing a holding spindle (c), a sleeve outer body (26) is provided around the outer circumference of the spindle axis (24) with ball bearings (28) to easily follow the rotation of the can (a) and to reduce sliding between the sleeve outer body (26) and the can (a), but there still remains disadvantageous in the holding spindles (A)(B) as illustrated in FIGS. 1 and 2.

It is a main object of this invention to provide a holding spindle for accurately and clearly printing and coating at a predetermined position an outer surface of a cylindrical container at high speed.

It is an object of this invention to provide a holding spindle which does not result in damages to an inside surface of a cylindrical container during printing and coating.

It is another object of this invention to provide a holding spindle in which a cylindrical container is held without allowing a tip periphery of the holding spindle to contact an inside bottom surface periphery of the cylindrical container, with the results of both abrasion in the tip periphery of the holding spindle and reduction of the working ratio of the printing and coating apparatus due to frequent repairs and exchanges.

It is another object of this invention to provide a holding spindle for supplying a two-place holding way whereby a sleeve outer body holds an inner peripheral surface of a body of a cylindrical container, while a bottom receiving pad vacuously holds an inside bottom surface of a bottom.

It is other object of this invention to provide a holding spindle which is effective for two-piece cans, especially thin elastic cylindrical containers with bottoms.

It is a further object of this invention to provide a holding spindle for settling a received position for a cylindrical container for a holding spindle by a vacuum holding force.

It is a still a further object of this invention to provide a holding spindle in which a bottom receiving pad is exchangeable in conformity with the curvature of an inside bottom surface of a bottom end of a cylindrical container to produce a seal action.

It is a still further object of this invention to provide a holding spindle in which a sleeve outer body and a bottom receiving pad are rotatably independently incorporated with each other.

It is an additional object of this invention to provide a holding spindle in which the respective sleeve outer body and bottom receiving pad of the holding portion material are rotatably independently of each other.

The above and other related objects of this invention will be apparent from the following description of the disclosure found in the accompanying drawings.

DESCRIPTION OF THE PREFERRED EMBODIMENTS

A holding spindle of this invention for a cylindrical container, in rotatably holding the cylindrical container, holds an inside peripheral surface of a body of a container to rotatably follow the rotation of the container with the non-contact condition that rotary friction force does not occur in the inside bottom surface periphery of the container. The sleeve outer body including a hollow spindle axis therein and holding removably an inner surface of the body of the container, and the bottom receiving pad having an aspiration opening at the central receiving surface providing a vacuum and holding the inside bottom surface of the bottom end of the container are racingly disposed on the hollow spindle axis to make the rotation of the inside bottom surface of the bottom end follow the rotation of the container. Resulting rotation holds the container.

Figure 1:
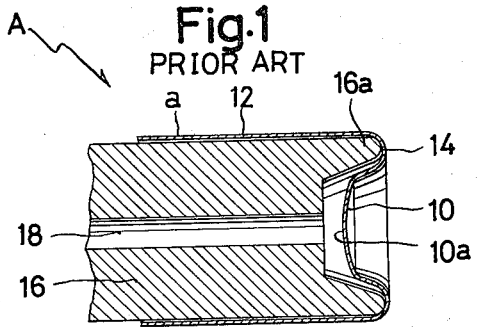
Fig.1 PRIOR ART
FIGS. 1 to 3 are central vertical sectional views showing various conventional types of holding spindles holding two-piece cans.
Figure 2:
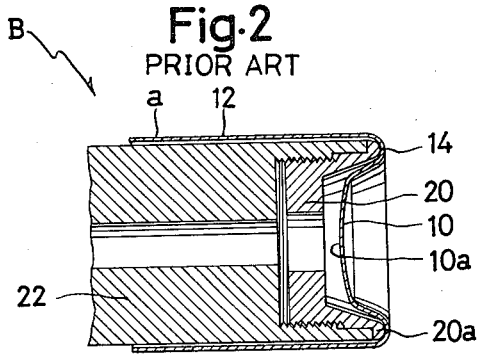
Fig.2 PRIOR ART
Figure 3:
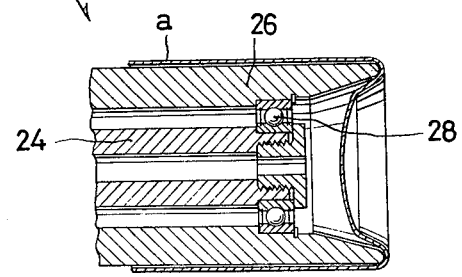
Fig.3 PRIOR ART
Figure 4:
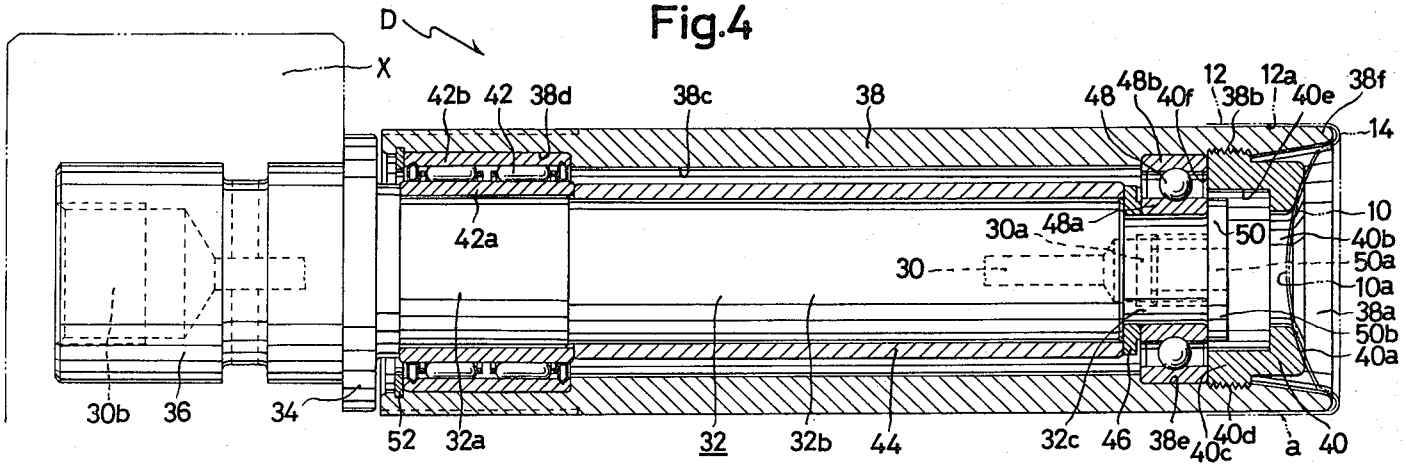
FIG. 4 is a partial central vertical sectional view showing a first embodiment of this invention holding a two-piece empty can.

FIG. 4 shows a first embodiment of a holding spindle of this invention for a two-piece can (a) as a representative example of a thin elastic cylindrical container with a bottom.

In the empty can holding spindle (D) of this invention, a base portion (36) is divided by an outer peripheral flange (34) of a spindle shaft (32) through which an aspiration hole (30) extends along the total length. The aforesaid being mounted to a side of a spindle conveyor (X). A sleeve outer body (38) removably holding the inside peripheral surface (12*a*) of the body (12) of the can (a) is idlingly placed on from the tip of the spindle shaft (32) to the outer flange (34), while a bottom receiving pad (40) has an aspiration aperture (40*b*) at the center of a receiving seat surface (40*a*) for vacuously holding the inside bottom surface (10*a*) of the can (a). These are independently and interchangeably incorporated with the sleeve outer body (38) by screwing a thread (38*b*) on the sleeve outer body (38) into the thread (40*d*) formed on an outer peripheral surface of the flange (40*c*).

The spindle shaft is formed in a four-step-decreasing diameter shape from the outer flange (34) to the tip. An inner ring (42*a*) of the roller bearing (42) and a sheath (44) are disposed on the second step portion (32*a*) and along the full length of the third step portion (32*b*) respectively. An inner ring (48*a*) of the ball bearing (48) is disposed on the fourth step portion (32*c*) through a ring (46). A mouth piece flat head bolt (50) having the aspiration aperture (50*a*) is screwed into the tip screw opening (30*a*) and is fixed by the flat head (50*b*) thereof pressing the inner ring (48*a*) of the ball bearing (48).

The outer diameter of the sleeve outer body (38) is a little bit smaller than the inside diameter of the can body (12) of the can (a). The sleeve outer body (38) is fixed both at a wide-diameter portion (38*d*) by providing the outer ring (42*b*) of the roller bearing (42) around the inner circumference thereof and by a snap ring (52) and at the circular end surface (40*b*) of the bottom receiving pad (40) in the wide-diameter portion of the tip of the inside peripheral surface by providing the outer ring (48*b*) of the ball bearing (48) around the inner circumference thereof. The inside peripheral surface of the tip opening (38*a*) is formed in an inverse taper shape with a trumpet-like configuration toward the tip.

The bottom receiving pad (40) is shaped as a cylindrical cap formed with a concave portion (40*e*) including a flat head (50*b*) of the mouth piece flat head bolt (50). The receiving seat surface (40*a*) is formed as a receiving surface in conformity to the curvature of the inside bottom surface (10*a*) concavely formed in the dome shape of the can (a) with an applicable vacuum seal. The receiving seat surface (40*a*), in case of providing the empty can (a) on the sleeve outer body (38) for printing and coating, is placed within the tip opening (38*a*) of the sleeve outer body (38) to preclude contact of the radius portion (14) of the can bottom (10) of the can (a) with the tip periphery (38*f*) of the sleeve outer body (38) when the can (a) is put on the sleeve outer body (38) and provides for rotation of the sleeve outer body (38) relative to the spindle shaft (32).

In FIG. 4, (30*b*) is a fixed opening provided at the base end of the aspiration hole (30) and is used for inserting and fixing the joint mouth piece to a pipe from a vacuum source (not shown).

Figure 5:
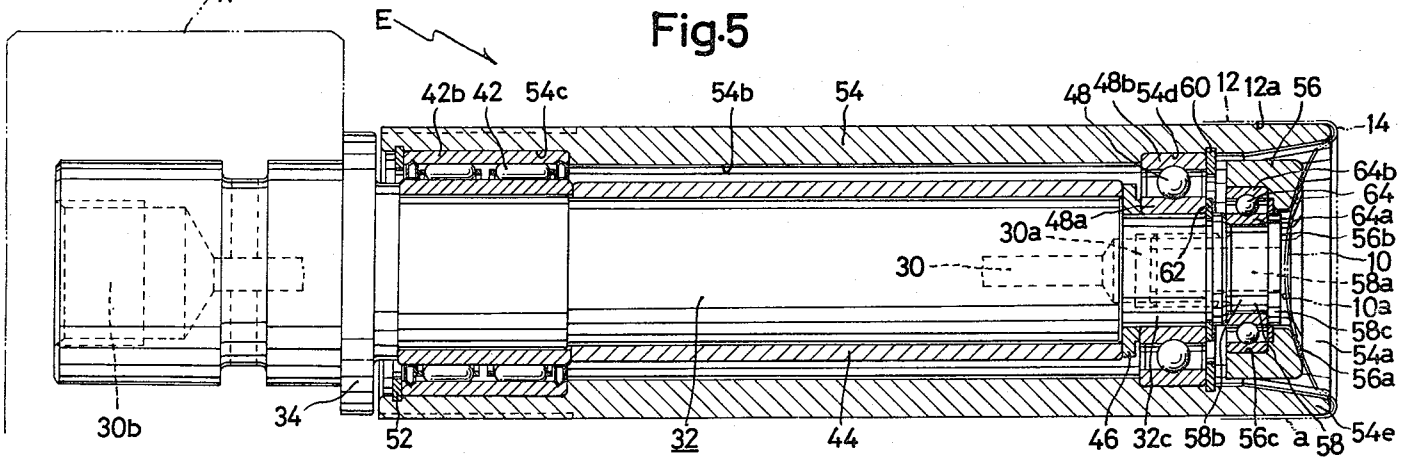
FIG. 5 is a partial central vertical sectional view showing a second embodiment of this invention holding a two-piece empty can.

FIG. 5 shows a second embodiment of a holding spindle of this invention.

In an empty can holding spindle (E), a hollow spindle shaft (32), roller bearing (42), a sheath (44), a ring (46), ball bearing (48) and a snap ring (52) are the same as those of the first embodiment, and the elements are provided with the same reference numbers.

The sleeve outer body (54) removably holding the inside peripheral surface (12*a*) of the body (12) of the can (a) is idlingly placed on from the tip of the spindle shaft (32).

The bottom receiving pad (56) has an aspiration opening (56*b*), which faces a tip screw opening (30*a*) of the aspirating hole (30) opened at the tip surface of the spindle shaft (32). The aspirating hole 30 is at the center of the receividng seat surface (56*a*) which seats and vacuously holds the inside bottom surface (10*a*) of the bottom (10) of the can (a). The pad (56) is racingly and exchangeably attached to a chin portion (58*b*) of a mouth piece flat head bolt (58) with a chin. The bolt (58) has a through aspirating aperture (58*a*) in the center of the axis and is screwed into the thread opening (30*a*) independently of the sleeve outer body (54).

The outer diameter of the sleeve outer body (54) is a little bit smaller than the inner diameter of the body (12) of the can (a). An outer ring (42*b*) of the roller bearing (42) is disposed at the wide-diameter portion (54*c*) of the inside periphery surface of the base end of the sleeve outer body (54) and is fixed by the snap ring (52). The outer ring (48*b*) of the ball bearing (48) is disposed at a wide-diameter portion (54*d*) of the inner peripheral surface of the tip of the sleeve outer body (54) and is fixed by a snap ring (60) provided on the inner peripheral surface (54*b*) of the sleeve outer body (54). An inner ring (48*a*) of the ball bearing (48) is fixed by a snap ring

(62) provided on the fourth stage outer peripheral (32*c*) of the spindle shaft (32). The inner peripheral surface of the tip opening (54*a*) is formed with an inverse taper shape, that is a trumpet-like shape, toward the tip.

As regards the receiving pad (56), the inner ring (64*a*) is provided around the outer circumference of the chin portion (58*b*) of the mouth piece flat head bolt (58) with a chin. The bolt 58 is threaded into the tip of the spindle shaft (32). The receiving pad (56) has a cylindrical cap shape and has a cave portion (56*c*) which exchangeably receives the outer ring (64*b*) of the ball bearing (64) therein. The inner ring (64*a*) is pressed and fixed by the flat head (58*c*). The receiving seat surface (56*a*) is formed on a vacuum applied surface in conformity to the curvature of the inside bottom surface (40*a*) concavely formed in the dome shape of the can (a) with the applicable vacuum seal. The receiving seat surface (56*a*), in case of providing the empty can (a) on the sleeve outer body (54) for printing and coating, is placed within the tip opening (54*a*) of the sleeve outer body (54) to preclude contact of the radius portion (14) of the can bottom (10) of the can (a) with the shaped tip opening periphery (54*e*) of the sleeve outer body (54).

In the empty can holding spindles (D)(E) of this invention, as set forth in the above description, with the cans (a) provided on the sleeve outer bodies (38)(54) during coating and printing, when vacuum is applied through the base end fixed portion (30*b*) of the spindle shaft (32), the aspiration hole (30) and aspiration apertures (50*a*)(58*a*) of mouth piece flat head bolts (50)(58), the inside bottom surface (10*a*) of the bottom (10) of the can (a) is drawn in and held on the receiving seat surfaces (40*a*)(56*a*). Precise seating or settlement in good position results in clearance of about 0.5 mm between the tip opening peripheries (38*f*)(54*e*) of the sleeve outer bodies (38)(54) and the radius portion (14) of the inside bottom surface periphery of the can (a), and therefore both do not come into contact with each other. Accordingly, there is no damage and abrasion, which frequently occur in conventional apparatus, between the tip opening peripheries (38*f*)(54*e*) and the radius portions (14) and thus occurs without reducing the gage-function in the tip of the empty can holding spindle (D)(E). In addition, surface contact between the inside bottom surface (10*a*) of the can (a) and the receiving seat surfaces (40*a*)(56*a*) of the receiving pads (40)(56) makes the holding settle and the rotation of the sleeve outer bodies (38)(54) and the receiving pads (40)(56) easily follow the rotation of the can (a) with the minimum occurrence of sliding rotary friction. In particular, in the empty can holding spindle (E), the rotation of the sleeve receiving pad (56) independently of the rotation of the sleeve outer body (54) easily forms the incorporated rotary structure. Therefore, the inside bottom surface (10*a*) is not damaged, and abrasion of the bottom receiving pad (56) and the number of times for exchanging parts is reduced. Accordingly, the working efficiency of the printing and coating apparatus gradually increases and maintenance costs are greatly reduced. Hence, it is ideal for the bottom receiving pad (56) to be made of soft materials, but it may also be made of hard materials. And it goes without saying that any material, surface treatment and shape of the sleeve outer bodies (38)(54) and the bottom pads (40)(56) may be properly selected.

In a conventional holding spindle, the exchange life of parts is from a month to three months, but, in this invention, the exchange life is from six months to a year.

Therefore, compared with the conventional apparatus, it is less possible that shear and unevenness in printing and coating are produced. The apparatus of this invention is capable of following a high speed handling 800 to 1200 cans a minute.

What is claimed is:

1. A holding spindle mountable on a spindle shaft and utilized for printing and coating cylindrical containers comprising an outer sleeve means for receiving a cylindrical container, said outer sleeve means having an inner diameter less than the diameter of the cylindrical container to thereby provide a clearance between said outer sleeve means and the cylindrical container disposed thereon, bearing means rotatably mounting said outer sleeve means on said spindle shaft, bottom receiving pad means, said bottom receiving pad means having a seating surface, said seating surface having a curvature corresponding to the curvature of the bottom surface of said cylindrical container, aspirating means applying a vacuum to said seating surface, said aspirating means comprising an opening in said seating surface leading to a source of vacuum and providing a vacuum to effect seating and mating of the common curvature of said seating surface and the inside bottom surface of said cylindrical container to thereby enhance the stability of the cylindrical container on the holding spindle, and mounting means detachably mounting said bottom receiving pad means to provide for readily replacing and changing said bottom receiving pad means to accommodate cylindrical containers having bottom surfaces of differing curvature, said mounting means comprising a bearing between said spindle shaft and said bottom receiving pad means to rotatably support said bottom receiving pad means on said spindle shaft independently of said outer sleeve means.

* * * * *